US005924341A

United States Patent [19]

Brooks

[11] Patent Number: 5,924,341

[45] Date of Patent: Jul. 20, 1999

[54] TUBE FITTING RATCHET TOOL

[76] Inventor: Eugene M. Brooks, 1528 Tator Ct., Bloomfield Hills, Mich. 48302

[21] Appl. No.: 08/848,083

[22] Filed: Mar. 22, 1996

Related U.S. Application Data

[63] Continuation of application No. 08/329,821, Oct. 27, 1994, abandoned.

[51] Int. Cl.[6] ..... B25B 13/46

[52] U.S. Cl. ..... 81/58.2; 81/61

[58] Field of Search ..... 81/58.2, 58, 60, 81/61, 57.33, 57.15, 57.18, 57.2

[56] References Cited

U.S. PATENT DOCUMENTS

| | | | |
|---|---|---|---|
| 1,422,121 | 7/1922 | Milen | 81/58.2 X |
| 2,527,033 | 10/1950 | Rodgers et al. | 81/61 |
| 2,536,172 | 1/1951 | Halperin | 81/60 |
| 2,551,669 | 5/1951 | Hale | 81/58.2 |
| 2,757,564 | 8/1956 | Reaves | 81/58.2 |
| 3,504,579 | 4/1970 | Harlan | 81/58.2 |
| 4,604,919 | 8/1986 | Rollo | 81/58.2 |
| 5,454,283 | 10/1995 | Stefano | 81/58.2 |

FOREIGN PATENT DOCUMENTS 24953 10/1909 United Kingdom .

OTHER PUBLICATIONS

Imperial–Eastman Ratchet Wrenches and Adapters, circa 1973.

*Primary Examiner*—D. S. Meislin

*Attorney, Agent, or Firm*—Gifford, Krass, Groh, Sprinkle, Anderson & Citkowski, P.C.

[57] ABSTRACT

Disclosed is a novel means for connecting and disconnecting fluid line couplings usually encountered in the automotive, refrigeration, and plumbing industries. The present invention comprises a common ratcheting handle adapted to receive a plurality of standard sized cogwheels. Independently, a cogwheel, having peripheral radially extending gear teeth and a central polygonal aperture intersected by a free opening is slidably positioned along a tubular conduit and onto a nut. The handle, having a cradle, is mated to the cogwheel and worked ratchet fashion to achieve a desired task. Said cradle has a set of oppositely situated spring biased pawls which simultaneously work the flats of the cogwheel teeth and intermittently collapse into a chamber thereby assuring that at least one pawl is in contact with the cogwheel to apply rotational force and to prevent accidental separation of the cogwheel from the handle. To reverse the direction of the rotational force the handle is turned around and refitted to said cogwheel.

2 Claims, 1 Drawing Sheet

TUBE FITTING RATCHET TOOL

This is a continuation of application Ser. No. 08/329,021, filed Oct. 27, 1994, now abandoned.

FIELD OF THE INVENTION

The invention relates in general to hand tools used to connect, or disconnect fasteners. Said fasteners being primarily used to couple tubular fluid transfer members. The field of use encompasses automotive, refrigeration, plumbing, electrical, and other fields where tubing or rod couplings are employed. There is also usefulness with bolt heads or nuts where access is very limited or where the exposed bolt is too long to allow the use of an ordinary socket wrench, the socket being too shallow.

BACKGROUND OF THE INVENTION

In modern machinery it is often necessary to use tubing to supply the many different types of fluids such as fuel, coolant, air, and lubrication. Tubing is also responsible for discharging or circulating different fluids. The ratchet tool of this invention is adapted to transmit unidirectional forces about an axis such as required in loosening or tightening nuts or couplings which are used on tubings and on bolt heads or nuts where access is severely limited.

An open-end wrench generally contacts a nut or coupling on only two surfaces and the force of loosening or tightening the nut or coupling may be sufficient to cause damage and require replacement. This is particularly a problem where the nut is formed of a relatively soft material, such as brass, copper, or plastic, which is used extensively in the pipe coupling industry. A brass coupling, for example, may become "frozen" or jammed on a pipe, requiring considerable force to be removed. An open-end wrench may damage the pipe and the coupling, requiring replacement of the entire system. A closed ratchet wrench cannot be used in many of these applications because the nut or coupling is threaded at both ends, or otherwise attached, to another member such as a pipe or rod or because access to the workplace is limited.

There are many hand tools cited in the prior art which attempt to address the above mentioned problems. This art utilizes a ratcheting device which is either complex in deployment or is limited to one size. As will be described, the present invention not only utilizes a novel ratcheting means, it also allows for a plurality of wrench heads, being graduated to fit commonly used or special sizes, and to be interchangeable in a common handle. The ratchet tool of this invention almost completely surrounds the work piece applying pressure to all six sides or to five of the corners, depending on the configuration of the central aperture.

It is an objective of the present invention to provide a means for allowing hexagonal fasteners, located in close quarters or hard to reach areas, to be driven and undriven by first inserting the circular cogwheel into the handlemember, the latter having a receivable cradle. The assembled tool is then placed so that the opening of the cogwheel fits onto the pipe and is slid over the fastener. The assembly is then rotated in ratchet fashion to complete the desired task. A second method of use is to fit the cogwheel over the fastener and then place the cradle of the handle member over the cogwheel.

It is a further objective of the present invention to provide a ambi-directional ratcheting handle capable of driving a plurality of circular cogwheels thereby causing a centrally disposed fastener to perform a desired result. Said handle and gear wrenches comprise a kit able to fit most common sized nuts associated with tubular fastener methods.

It is a still further objective of the present invention to provide for a mechanically actuated drive source, such as pneumatic or hydraulic, which the tool operator would control with a palm or finger trigger. Such a device would be pervasive in a modern industrial assembly line where manually operated tools have been linked to musculoskeletal disorders such as Carpal Tunnel Syndrome.

A final objective of the present invention is to provide a superior means for dislodging stuck, or frozen, tube fasteners without stripping the corners of the hex nut itself.

SUMMARY OF THE INVENTION

The preferred ratchet tool includes a circular cogwheel having radially extending peripheral gear teeth and a central aperture which receives the nut, coupling or the like, there being a slot which replaces a portion of the central aperture for the purpose of admitting a tube. The handle portion of the ratcheting wrench terminates in a generally semi-circular cradle, said cradle having oppositely placed pawl members which engage the teeth of the ratchet wheel for a primary purpose of applying intermittent, rotational force in a single direction, which is necessary in a ratcheting operation, and which pawls contact the cogwheel from disengagement from the cradle by maintaining contact with and pressure against the teeth. In the working phase of the ratcheting operation if one pawl is located within the slot of the ratcheting wheel the other pawl is in contact with the teeth with the result that there is always pressure to turn the wheel as well as to keep the wheel from falling out of the handle cradle.

Said handle cradle is adapted to receive a plurality of cogwheels with central apertures for predetermined nut sizes. Each cogwheel has a free opening located to cover one corner of a hexagonal nut and sufficiently wide to allow the user to slide the cogwheel over an obstruction such as a tube or rod and onto a workpiece. To rotate the workpiece in the opposite direction the handle member is turned over and replaced in position on the cogwheel.

In an unusually limited work situation, to release the cogwheel, the optimal load bearing pawl, having a manipulating pin protruding either side plate of the cradle, is manually retracted into a spring loaded chamber positioned along the radial cradle wall. The handle is then lifted toward the opposite pawl thereby separating the handle from the cogwheel. To reverse load direction, the handle is turned over and reset to the cogwheel.

In another embodiment of the disclosed invention, a pneumatic fluid source is supplied to two pawl wheels located at the drive points of the radial cogwheel cradle. A pneumatic supply fitting is located at the distal end of the handle and attached to a fluid source. The handle, being hollow, allows the pressurized fluid passage to a throttle which controls the rotation of said pawl wheels. The two pawl wheels are located oppositely to each other, one pawl being used to restrict the ratchet wheel within the radius of the cradle and to drive the cogwheel when the other pawl wheel is located within the slot of the cogwheel. The above mentioned art, being widely cited in the prior art, is not further described at this time.

Still another embodiment has the standard tool handle available with a plurality of cogwheels having sized openings, said cogwheels being housed in a caddy. BRIEF DESCRIPTION OF THE DRAWINGS In the drawings, where like reference numerals are used to indicate identical components in the various figures.

DETAILED DESCRIPTION OF THE EMBODIMENT

Figure 1:
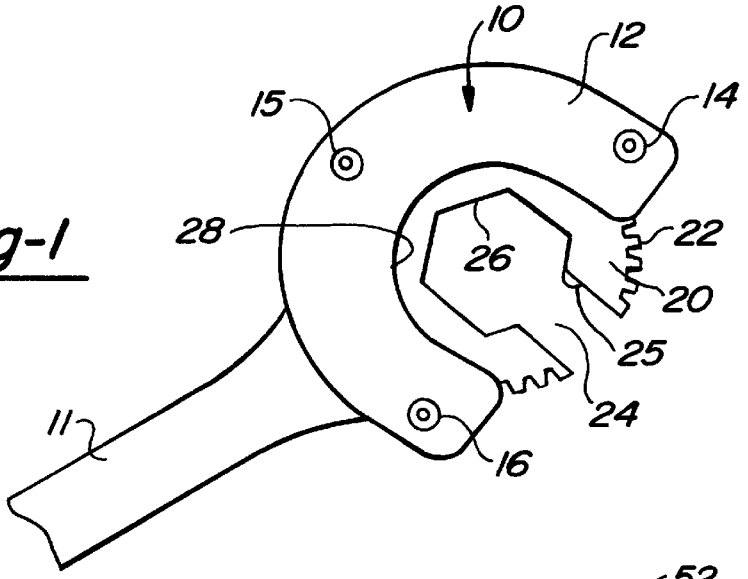
FIG. 1 is a fragmentary side elevation of the present invention depicting a seated cogwheel member of a graduated plurality of hexagonal nut drivers.

As seen in FIG. 1, a ratchet tool 10 is shown comprising a handle 11 and a cradle 28. Said cradle 28 has a common radius to receive a cogwheel 20. Said cogwheel 20 is prevented from lateral deviation by a first plate 12, and a second plate 13 as seen in FIGS. 3 and 4, both plates 12 and 13 fastened by Allen head screws 14, 15, and 16.

Figure 2:
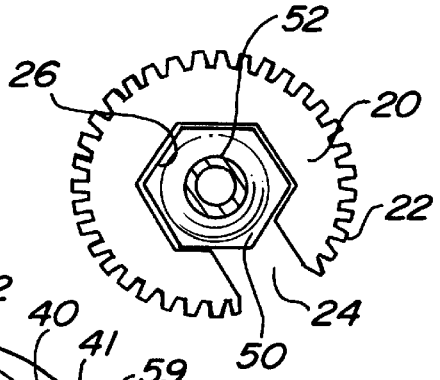
FIG. 2 is a top view, in partial cross section, of a cogwheel member as engaged to a flare nut, being most commonly used to couple, or fasten, tubular fluid transfer conduits.

The cogwheel 20, has a plurality of radially displaced teeth 22 and a generally hexagonal aperture 26, which works against the flats of a similar geometric fastener 50 (FIG. 2). Intersecting said radius 22 is a free opening 24 and a retaining spring loaded ball 25. Said free opening 24 allows the cogwheel 20 to be inserted over a conduit 52 (FIG. 2), and onto a fastener 50. The cogwheel 20 then receives the cradle 10 which drives the cogwheel 20 using a set of pawls 17 and 40 (as viewed in FIG. 3). To disengage said cogwheel 20, if occasionally needed, a pin 19, which protrudes from a slot 18, and runs through primary pawl 17, is retracted thereby collapsing the pawl 17 into a chamber 17*a* and allows said cogwheel 20 to exit said cradle 28.

As seen in FIG. 2, a cogwheel 20, having a plurality of peripherally displaced teeth 22, has a free opening 24 which allows a conduit 52 access to a central hexagonal aperture 26 slightly larger than the hexagonal sides of a flare nut 50.

Figure 3:
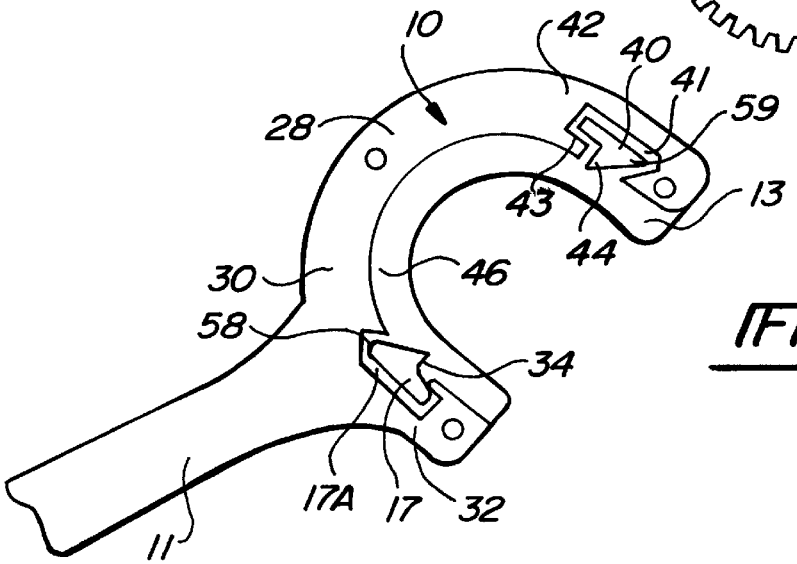
FIG. 3 is a fragmentary side elevation of the present invention having one, of a pair, of side plates removed to illustrate oppositely placed pawls.
Figure 4:
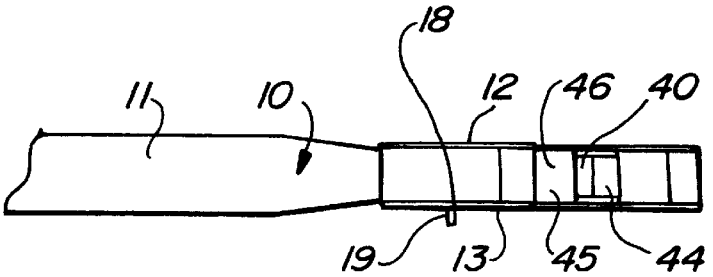
FIG. 4 is a fragmentary cross view of the underside of the present invention depicting the manipulator pins located centrally through one of the drive pawls. Also depicted is the protruding tooth member of the second pawl situated oppositely to the first pawl.

As seen in FIG. 3, a tool 10 comprising a handle 11, and a semi-circular cradle 30, has a first pawl 17 located in a cavity 17*a* and has a spring 32 which forces said pawl 17 against an opening in the cavity 17*a* thereby exposing the pawl tooth 34. Said tooth 34 then engages the peripheral teeth 22 of the cogwheel 20, thereby limiting one directional rotation of said cogwheel 20. Located through the pawl 17 is a pin 19 which is manually used to manuever said pawl 17 away from the tool cradle 28, usually at the end of a tube fastening operation. As viewed, plate 13 (one of two), prevents pawl deviation from radial wall 46.

Oppositely displaced from the first pawl 17 is a second pawl 40 located in a cavity 41, and spring 42 forced against cavity wall 43 thereby exposing the pawl tooth 44 along said cradle wall 46. Each of the two pawls 17, 40 therefore exerts sufficient force against the teeth of the cogwheel to prevent the cogwheel from falling out of the cradle.

FIG. 4 shows a tool 10 comprising a handle 11 connected to a semi-circular cradle 45 situated between a first plate 12 and a second plate 13. Said cradle has a pawl 40 with a protruding tooth 44 emerging from the wall 46. Oppositely displaced from pawl 40, is a pin 19 which controls internal movement of pawl 17 to facilitate cogwheel 20 release if needed.

While the foregoing embodiment of the present invention is well suited to achieve the above stated objectives, those skilled in the art should realize that the embodiment is subject to change, modification, and alteration without departing from the spirit and scope of the present invention.

Accordingly, it is to be understood that the present invention is not limited to the specific embodiment described herein, but should be deemed to extend to the subject matter defined by the appended claims, including all fair equivalents thereof.

Therefore, having described my new and useful invention in specific terms, I make the following claims:

1. A hand held ratchet wrench comprising:

a rigid semi-circular cradle, said cradle defining an interior semi-circular channel which is substantially U-shaped in cross section and oriented so that an open side of said channel faces an axis of said cradle, said cradle and said channel each having two open ends which are spaced apart from each other, an elongated handle having one end secured to said cradle, said handle extending radially outwardly from said cradle, said cradle having two radial recesses, said recesses being positioned closely adjacent said open ends of said cradle and in a facing relationship, a pawl disposed in each recess, a spring associated with each pawl which urges said pawls radially inwardly towards said axis of said cradle, a cogwheel having a toothed outer perimeter, a polygonal throughbore and a slot extending between said outer perimeter and said throughbore, said cogwheel being dimensioned so as to be freely slidable into said open ends of said channel to an engaged position in which said cradle overlies a portion of said outer perimeter of said cogwheel and in which said pawls operatively ratchetly engage said toothed outer perimeter of said cogwheel.

2. The invention as defined in claim 1 and comprising at least two cogwheels, said cogwheels having substantially identical outer diameters, said polygonal throughbores of said cogwheels being of different sizes.

* * * * *